US006767245B2

(12) United States Patent
King

(10) Patent No.: US 6,767,245 B2
(45) Date of Patent: Jul. 27, 2004

(54) MODULAR GFCI RECEPTACLE

(75) Inventor: Gerald N. King, Deer Park, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/045,541

(22) Filed: Oct. 26, 2001

(65) Prior Publication Data

US 2002/0072272 A1 Jun. 13, 2002

Related U.S. Application Data

(63) Continuation of application No. 09/492,891, filed on Jan. 27, 2000, now Pat. No. 6,309,248.

(51) Int. Cl.[7] ..... H01R 13/60
(52) U.S. Cl. ..... 439/535; 439/107; 361/42
(58) Field of Search ..... 439/107, 535, 439/538, 539, 650; 361/42–51; 335/18–24

(56) References Cited

U.S. PATENT DOCUMENTS 3,609,647 A * 9/1971 Castellano ..... 439/535
4,842,551 A * 6/1989 Heimann ..... 439/502
5,594,398 A * 1/1997 Marcou et al. ..... 335/18
5,637,000 A * 6/1997 Osterbrock et al. ..... 439/107
6,040,967 A 3/2000 DiSalvo ..... 361/42
6,156,971 A 12/2000 May ..... 174/59

* cited by examiner

*Primary Examiner*—Son V. Nguyen
(74) *Attorney, Agent, or Firm*—Paul J. Suton

(57) ABSTRACT

The modular electrical component for electrical wiring systems is provided. The modular electric component includes a removable electrical device, a base unit that fits within a junction box in the electrical wiring system and a mounting strap used to secure the base unit to the junction box. Typically, the removable electrical device has a plurality of power contacts that extend from a rear cover of the device, and the base unit has a plurality of terminal connections. The power contacts electrically connect to the terminal connections, when the replaceable electrical device is mated with the base unit. The movable electrical device may be, for example, a receptacle or switch. Preferably, the removable electrical device is a circuit interrupting device, such as a ground fault circuit interrupting device.

12 Claims, 15 Drawing Sheets

MODULAR GFCI RECEPTACLE

This is a continuation of application Ser. No. 09/492,891 filed Jan. 27, 2000, now is U.S. Pat. No. 6,309,248.

BACKGROUND

1. Field

Generally, the present application relates to modular electrical components, and more specifically to modular ground fault circuit interrupter receptacles.

2. Description of the Related Art

Electrical wiring systems in residential, commercial and industrial environments typically include a plurality of electrical devices interconnected by a plurality of conductors supplying power from a power disconnect (e.g., a circuit breaker) to the electrical devices. Examples of such electrical devices include receptacles, switches, and lighting fixtures. Typically, the electrical devices are wired to the conductors by licensed electricians.

Many different reasons may arise in which replacement of such electrical devices may be desired. The obvious reason being replacing broken devices. Another reason may be to change the color of such devices to blend in with the decor of a particular area.

Current electrical codes require that certain branch circuits in electrical wiring systems include circuit interrupting devices, e.g., circuit interrupting receptacles and circuit breakers, which are designed to interrupt power to various loads, such as household appliances, consumer electrical products and branch circuits. For example, electrical codes require electrical circuits in home bathrooms and kitchens to be equipped with ground fault circuit interrupter (GFCI) protection. Presently available GFCI devices include sense circuitry to detect the occurrence of ground faults, and a trip mechanism to mechanically open (or break) conductive paths between line and load conductors when a ground fault is detected. A test button is provided to test the trip mechanism and sense circuitry. Such GFCI devices are resettable after they are tripped using a reset button which mechanically resets the open conductive paths. Since such GFCI devices are mechanically reset, if the sense circuitry, for example, is non-operational, the device can continue to function as a standard receptacle when reset. An example of a presently available GFCI device is described in commonly owned U.S. Pat. No. 4,595,894, which is incorporated herein by reference.

As noted, circuit interrupting devices when tripped open conductive paths between line and load conductors so that power supplied to any electrical devices connected to the load side of the circuit interrupting device no longer are supplied power. One recent development in circuit interrupting technology involves preventing the circuit interrupting device from resetting if the sense circuitry and/or trip mechanism are non-operational. However, if the device is not operating properly and cannot be reset, the various electrical devices (e.g., receptacles, switches and lighting fixtures) connected to the load side of the circuit interrupting device are no longer supplied with electrical power. As a result, such devices cannot be used until the non-operational circuit interrupting device is replaced, preferably by a licensed electrician.

SUMMARY

The present application provides a modular electrical component concept that permits easy replacement of electrical devices in electrical wiring systems. In one embodiment the modular electrical component includes a base unit, a mounting strap used to connect the base unit to a junction box in the electrical wiring system and a removable electrical device that can be releasably connected to the base unit. The removable electrical device has a plurality of power contacts extending from a rear cover, and the base unit has a plurality of terminal connections. The power contacts and terminal connections are arranged so that when the removable electrical device is connected to the base unit, one contact engages one terminal connection.

Preferably, the mounting strap has at least one ground terminal connection that extends into the base unit and the removable electrical device has at least one ground contact extending from its rear cover. The at least one ground contact and at least one ground terminal connection are arranged so that when the removable electrical device is connected to the base unit, one ground contact engages one ground terminal connection.

The removable electrical device may be a receptacle, a switch, a circuit interrupting device or other devices used in electrical wiring systems. In an embodiment where the removable electrical device is a circuit interrupting device, the device may include a housing, and first and second electrical conductive paths disposed at least partially within the housing and connected to at least one of the plurality of power contacts. A circuit interrupting portion is disposed at least partially within the housing and is configured to break the continuity between the first and second conductive paths upon the occurrence of a predetermined condition, e.g., a ground fault. To reset the device after breaking continuity, a reset portion is provided to make electrical continuity between the first and second conductive paths. Preferably, the circuit interrupting device Includes a reset lockout portion that prevents the making of electrical continuity between the first and second conductive paths if the circuit interrupting portion is non-operational.

The circuit interrupting device may also include a trip portion that is configured to break the continuity between the first and second conductive paths independently of the circuit interrupting portion operation. The independent trip portion permits the device to be tripped even if the circuit interrupting portion is non-operational.

In one embodiment, the circuit interrupting portion includes a circuit interrupter used to facilitate making and breaking of electrical continuity between the first and second electrical conductive paths, and sensing circuitry used to sense the occurrence of the predetermined condition.

BRIEF DESCRIPTION OF THE DRAWINGS

Preferred embodiments of the present application are described herein with reference to the drawings in which similar elements are given similar reference characters, wherein.

DETAILED DESCRIPTION

Figure 1:
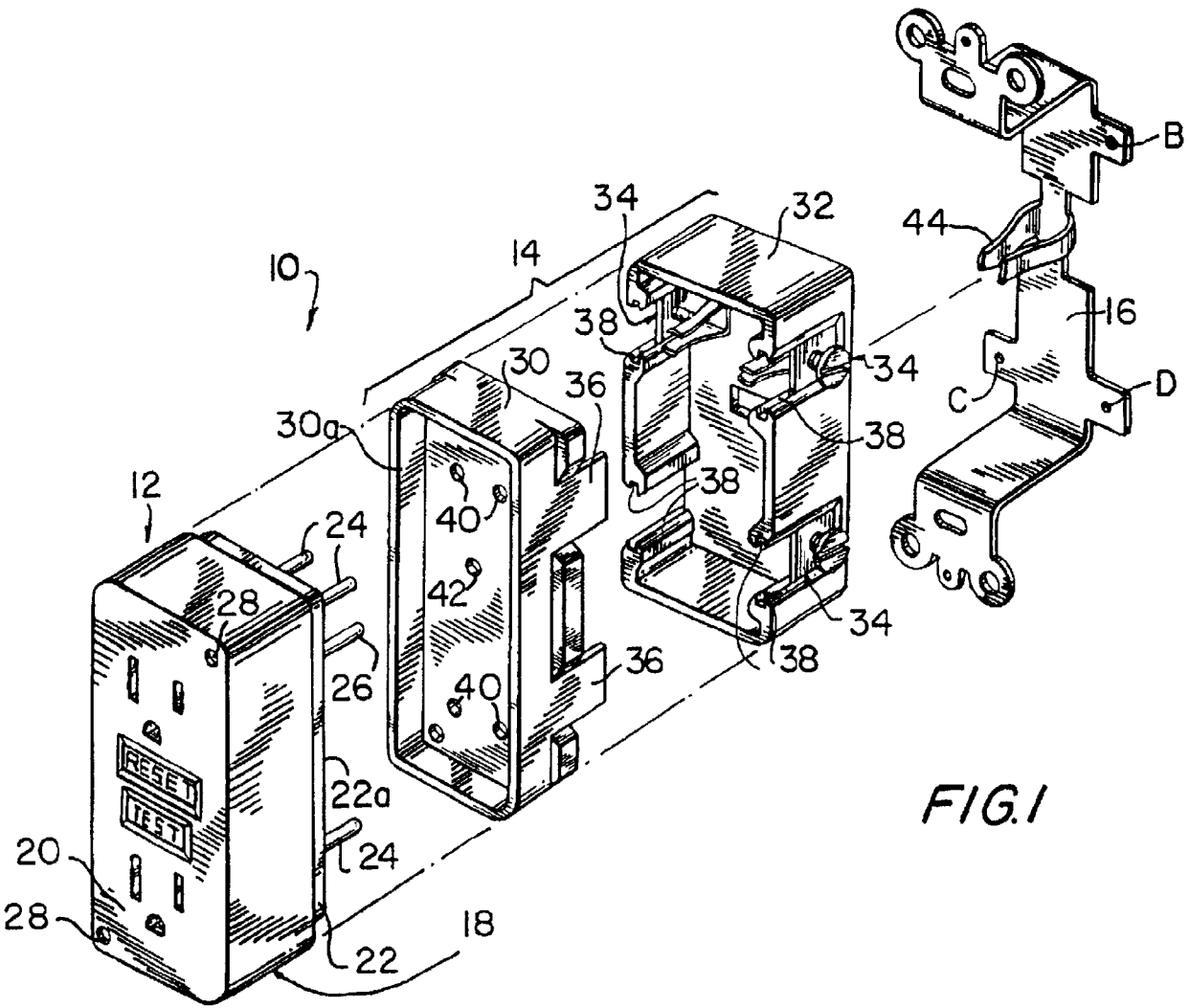
FIG. 1 is a perspective view, with parts separated, of one embodiment of a modular electrical component according to the present application, illustrating a replaceable electrical device, a base unit and a mounting strap.
Figure 2:
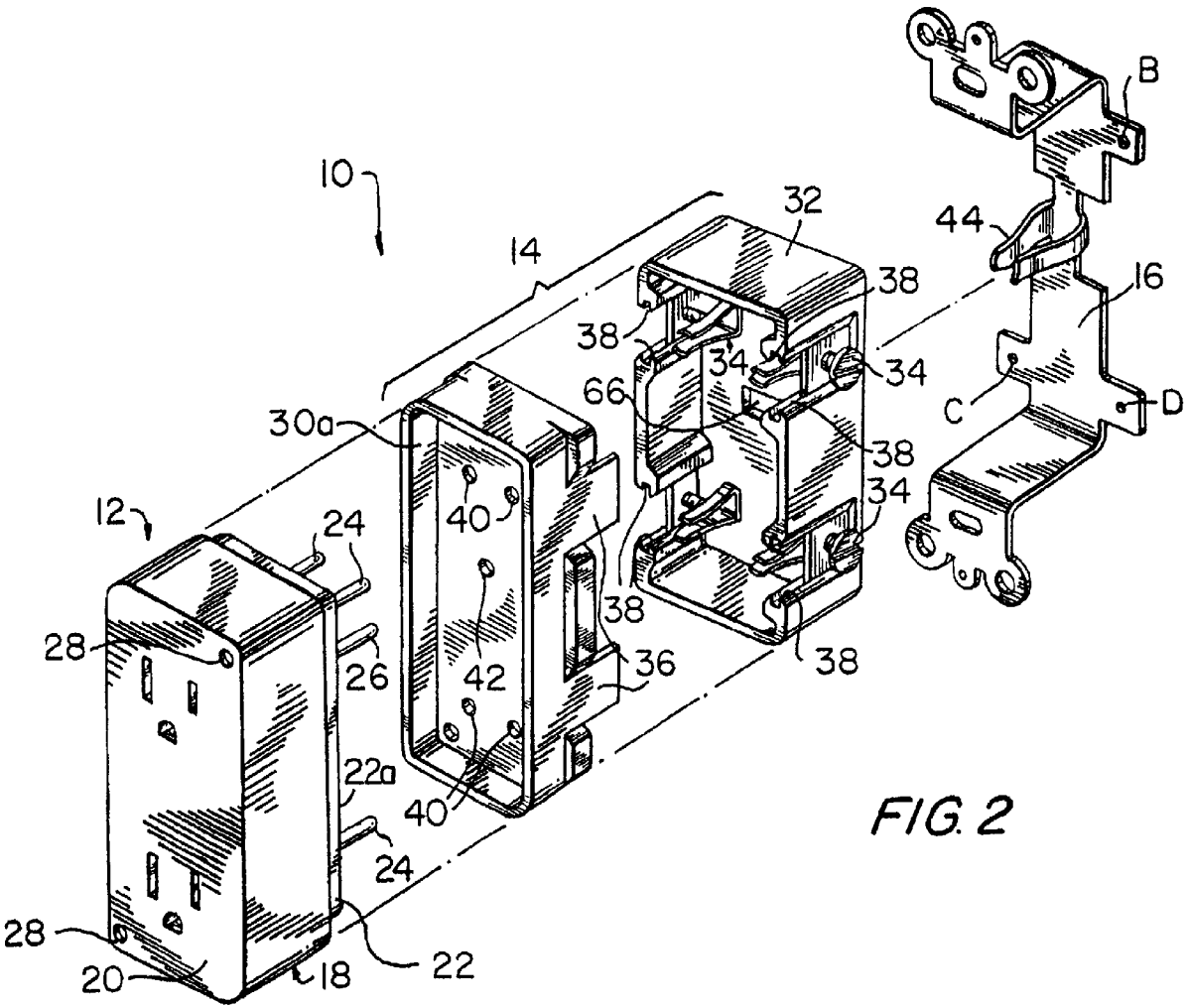
FIG. 2 is a perspective view, with parts separated, of an alternative embodiment of a modular electrical component according to the present application, illustrating a replaceable electrical device, a base unit and a mounting strap.
Figure 3:
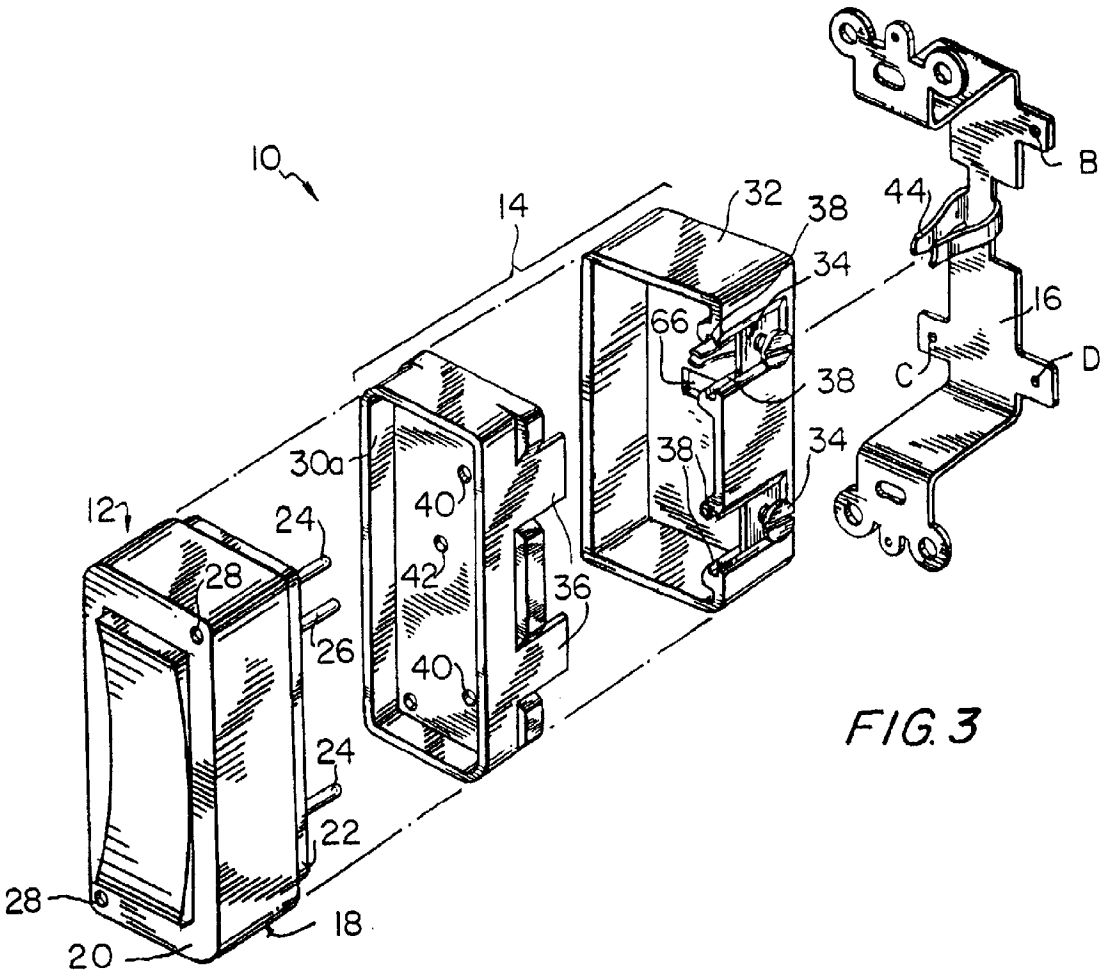
FIG. 3 is a perspective view, with parts separated, of another embodiment of a modular electrical component according to the present application, illustrating a replaceable electrical device, a base unit and a mounting strap.

The present application generally relates to modular electrical components suitable for use in electrical wiring systems, such as those existing in homes. In FIG. 1, the modular electrical component shown includes a removable circuit interrupting device that connects to a base unit. However, the modular electrical components contemplated by the present application include all of the various electrical devices that can be used in residential, industrial and/or commercial electrical wiring systems. Examples of such electrical devices include conventional grounded receptacles (seen in FIG. 2) and switches (seen in FIG. 3). Examples of circuit interrupting devices include ground fault circuit interrupting devices, arc fault circuit interrupting (AFCI) devices and circuit interrupting devices with combined circuit protection features, such as combined GFCI/AFCI devices.

Referring now to FIG. 1, the modular electrical component 10 includes a removable electrical device 12 and a base unit 14. The modular electrical component may also include a mounting member 16 that facilitates securing the modular electrical component to a junction box typically used in residential electrical wiring systems.

As noted above, the modular component concept according to the present application can be used with the various electrical devices that are used in electrical wiring systems. Examples of such devices include conventional grounded receptacles, switches, circuit interrupting devices (e.g., GFCI and AFCI devices), and circuit interrupting devices with combined circuit protection functions, such as combined GFCI/AFCI devices.

Typically, the electrical devices 12 include a housing 18 having a front cover 20 which is user accessible when the device is connected to the base unit 14, and a rear cover 22. The rear cover 22 has a portion 22*a* that is, preferably, configured to mate with or rest within a portion of the base unit 14. Internal electrical circuits, connections and/or conductors are provided to perform the particular function of the electrical device 12. One or more phase or neutral (or power) contacts 24 and one or more ground contacts 26 extend from the rear cover 22 of the housing 18. The power contacts 24 provide electrical connections to the base unit 14 as described below. Removable fasteners 28 are used to releasably secure the electrical device 12 to the base unit 14. However, other types of releasable fastening devices or mechanisms may be employed to releasably secure the device 12 to the base unit 14. An example of a releasable fastening mechanism is a quick disconnect snap lock that is normally biased in a locked position and is released when, for example, a button is depressed.

The base unit 14 is preferably configured and dimensioned to fit within a standard single gang junction box. However, the base unit can be dimensioned to fit as a single unit within multiple gang junction boxes such as a two gang junction box. The base unit 14 includes front and rear covers 30 and 32 which enclose terminal connections 34. The covers can be connected together using, for example, adhesives, fasteners, snap-lock connections or ultrasonic welds. The covers 30 and 32 are preferably made of an electrically insulating material, such as nylon, polycarbonate, PVC, or polypropylene, so as to prevent short circuits from occurring when inserting and removing the removable electrical device 12.

Figure 4:
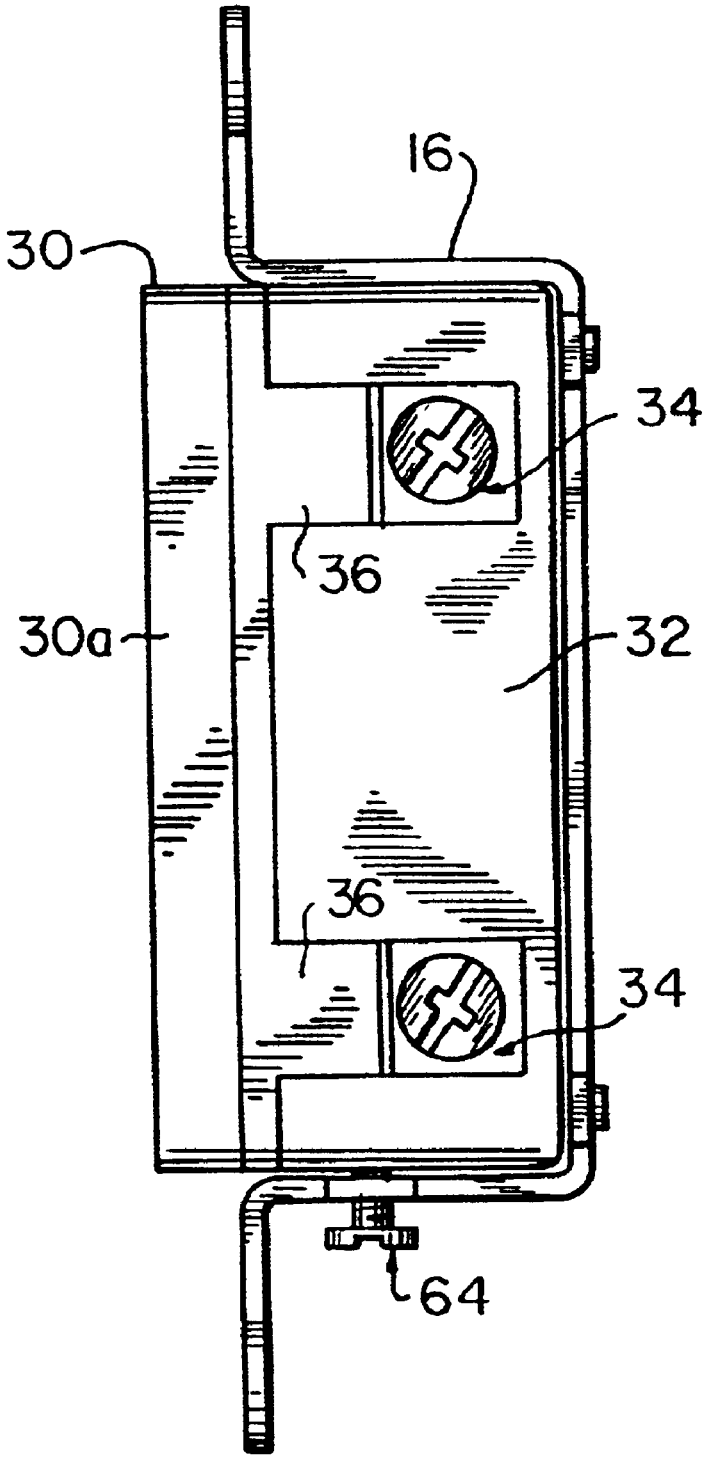
FIG. 4 is a side elevational view of the base of the modular electrical component secured to a mounting strap.

Continuing to refer to FIG. 1, the front cover 30 includes a device receiving portion 30*a*, which in the embodiment shown is a channel, configured to receive at least a portion 22*a* of the electrical device 12. The front cover 30 also includes one or more terminal connection retaining posts 36 which fit into channels 38 of the rear cover 32 as shown in FIG. 1. When the covers 30 and 32 are joined together, the retaining posts 36 hold the terminal connections 34 within the channels 38 of the rear cover 32, as seen in FIG. 4.

The front cover 30 also includes one or more power contact through holes 40 and one or more ground contact through holes 42. The through holes permit the power contacts 24 and ground contact 26, extending from the rear cover 22 of the electrical device 12, to pass through the front cover 30 and engage their corresponding terminal connection 34 or ground terminal connection 44 on mounting strap 16. Optionally, the through holes have a sealing member or other structure that 1) covers the through holes 40 and 42 when an electrical device is not connected to the base unit 14; and 2) permits a contact inserted into the hole to pass therethrough when a device 12 is connected to the base unit.

Figure 5:
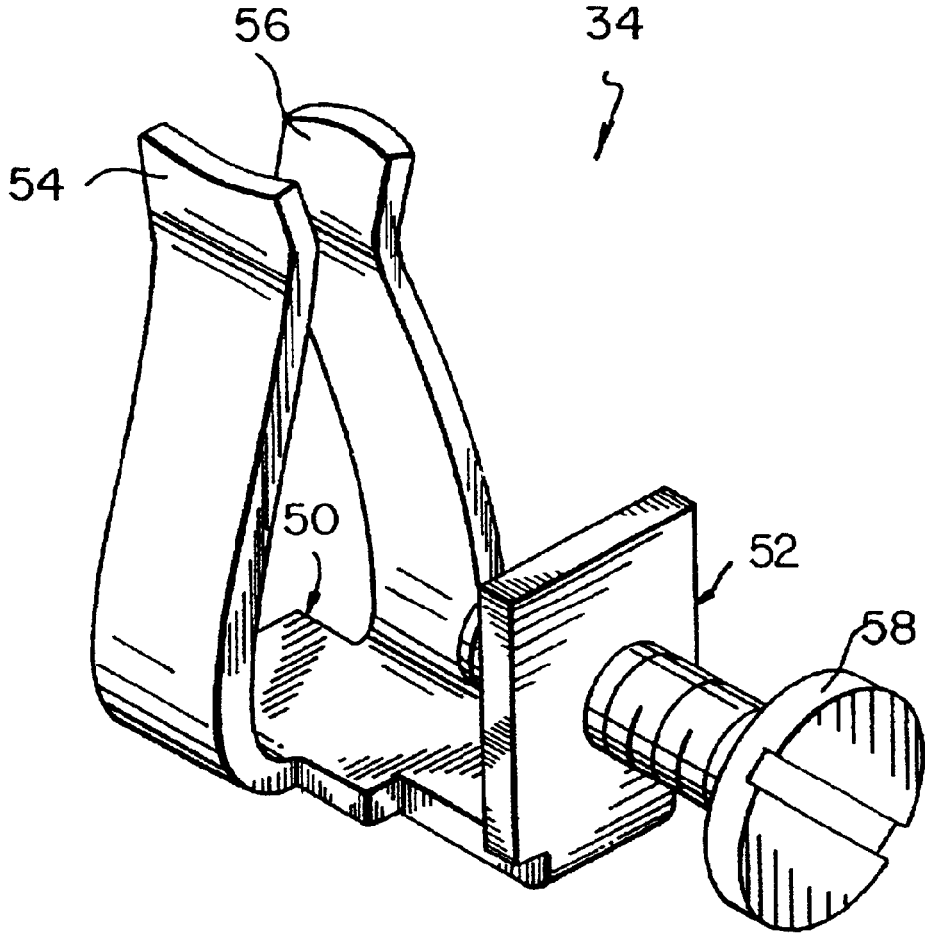
FIG. 5 is a perspective view of an exemplary embodiment of a terminal connection mounted within the base unit.

Referring to FIG. 5, an exemplary embodiment of a terminal connection is shown. Each terminal connection 34 has a first connection member 50 for electrically connecting the removable electrical device 12 to the base unit 14, and a second connection member 52 for electrically connecting the base unit to conductors in the electrical wiring system. In the terminal connection shown In FIG. 5, the first connection member 50 includes a pair of contact binding elements 54 and 56. Preferably, the contact binding elements are normally biased toward each other to facilitate engagement with a power contact 24 so that an electrical connection between binding elements 54 and 56 and the power contact 24 is made. The second connection member 52 includes screw terminal 58.

Figure 7:
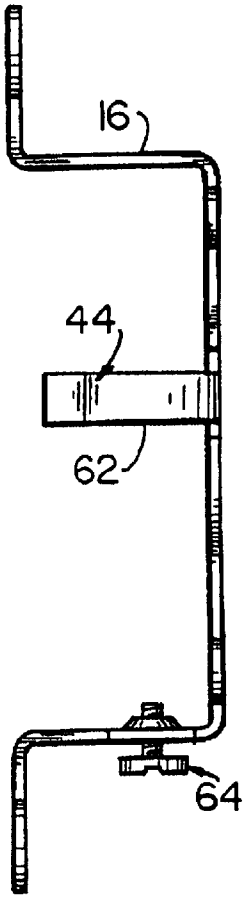
FIGS. 6 and 7 are front and side elevational views of a mounting strap used to mount the base of the modular electrical component to a junction box in an electrical wiring system.
Figure 6:
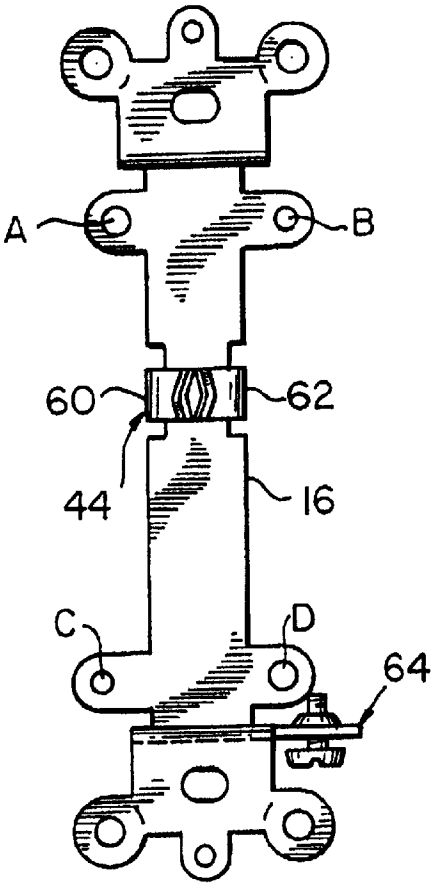

Referring to FIGS. 1, 6 and 7, to mount the base unit 14 to a junction box, a mounting strap 16 is connected to the base unit at points A–D. The strap 16 can be secured to the base unit 14 using, for example, fasteners or rivets. However, those skilled in the art would recognize various different techniques can be used to mount the strap to the base unit. As noted, the mounting strap 16 includes a ground terminal connection 44. In this embodiment, the ground terminal connection 44 includes a pair of contact binding elements 60 and 62, which are normally biased toward each other to facilitate engagement with a ground contact 26 in the electrical device 12. In this configuration an electrical connection between the device ground and the base unit ground is made. A second ground connection 64 secured to or formed into the mounting strap 16 is provided to electrically connect the base unit ground to ground conductors in the electrical wiring system.

As seen in FIG. 1, the ground terminal connection 44 extends through an opening 66 in the rear cover 32 of the base unit 14 so that the terminal connection 44 is aligned with the ground contact through hole 42 in the front cover 30.

Figure 8:
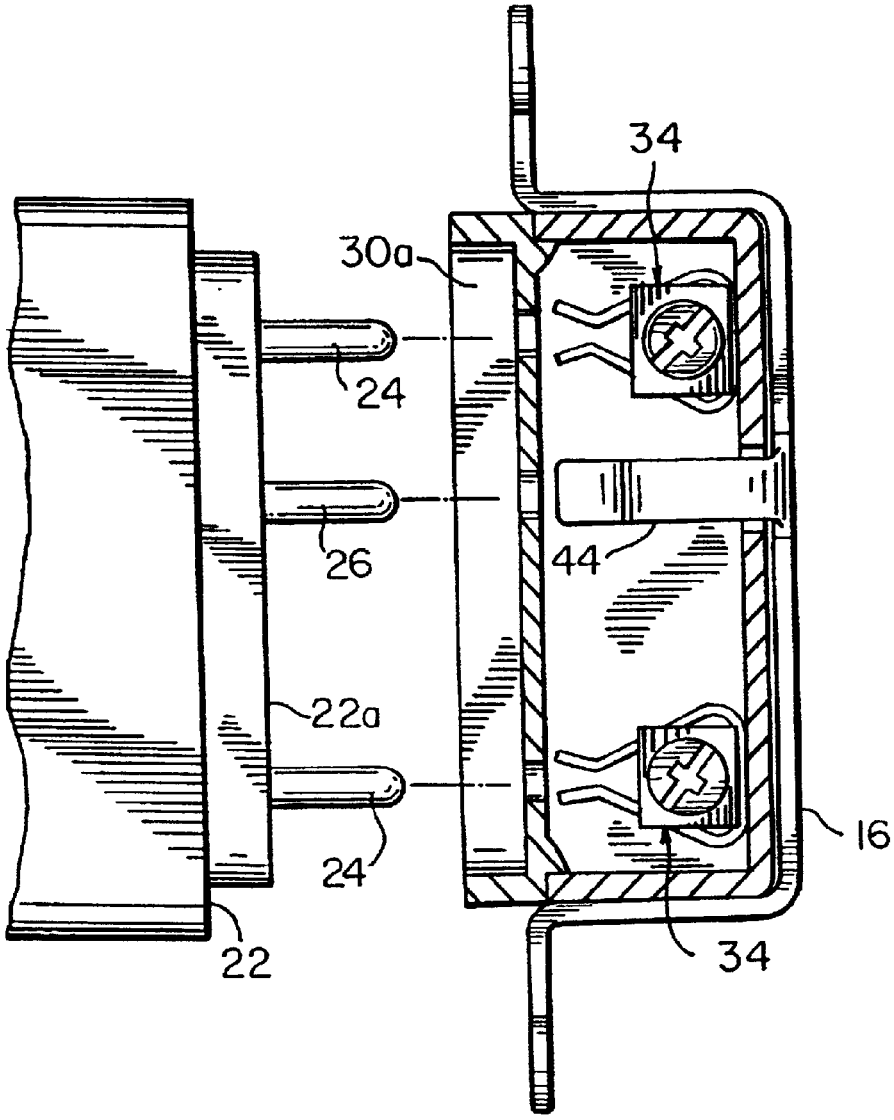
FIG. 8 is a side elevational view of a modular electrical component according to the present application, in partial cross-section, illustrating the electrical connections between the base and the replaceable electrical device.

FIG. 8 shows a mounting strap 16 secured to a base unit 14 in which the ground terminal connection 44 is located to engage ground contact 26 extending from the rear cover 22 of the electrical device 12. Similarly, power contacts 24 extending from the rear cover 22 of the electrical device 12 are aligned to engage terminal connections 34 in the base unit 14.

Figure 9:
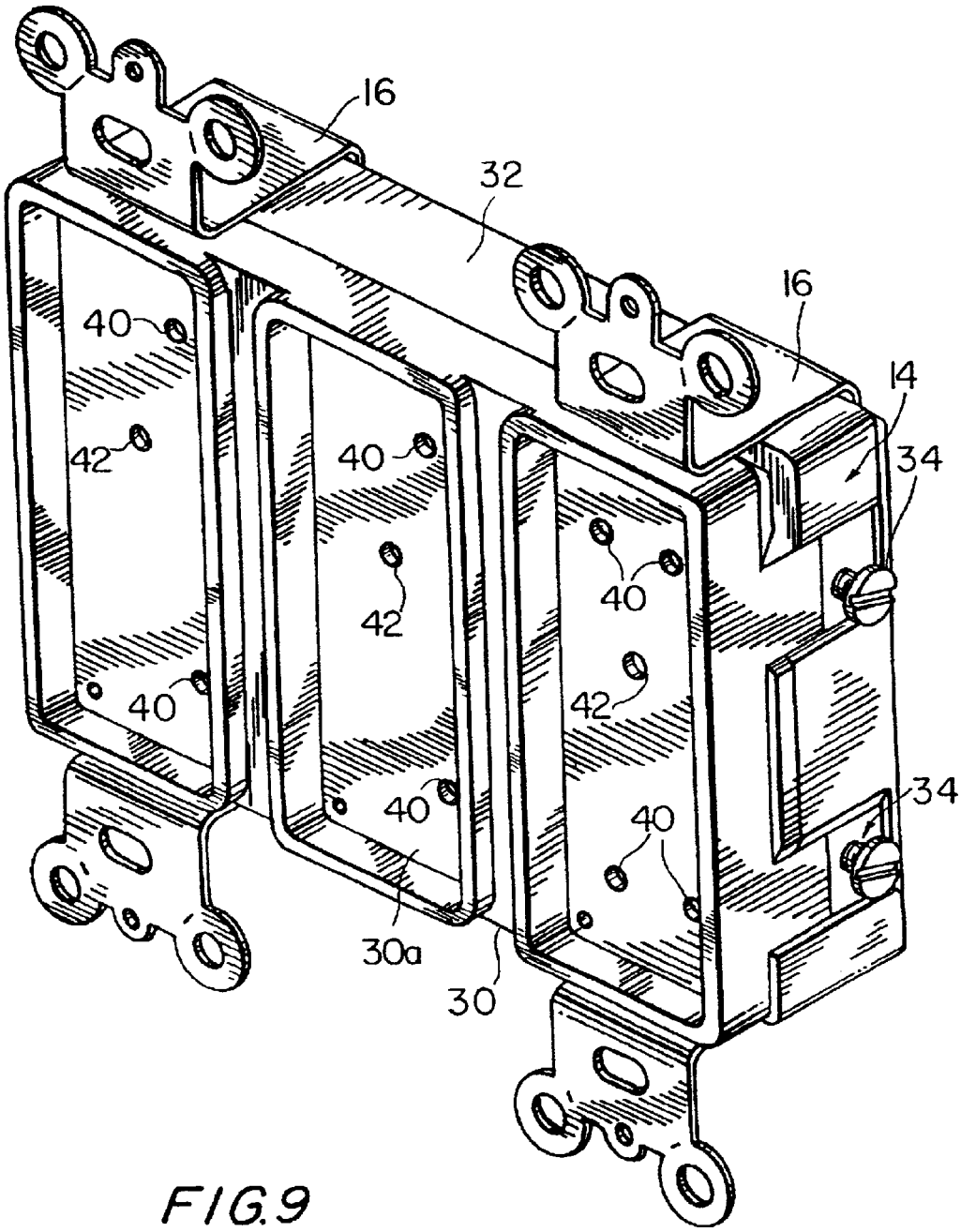
FIG. 9 is a perspective view of a base unit for a multi-gang modular electrical component according to the present application.
Figure 10:
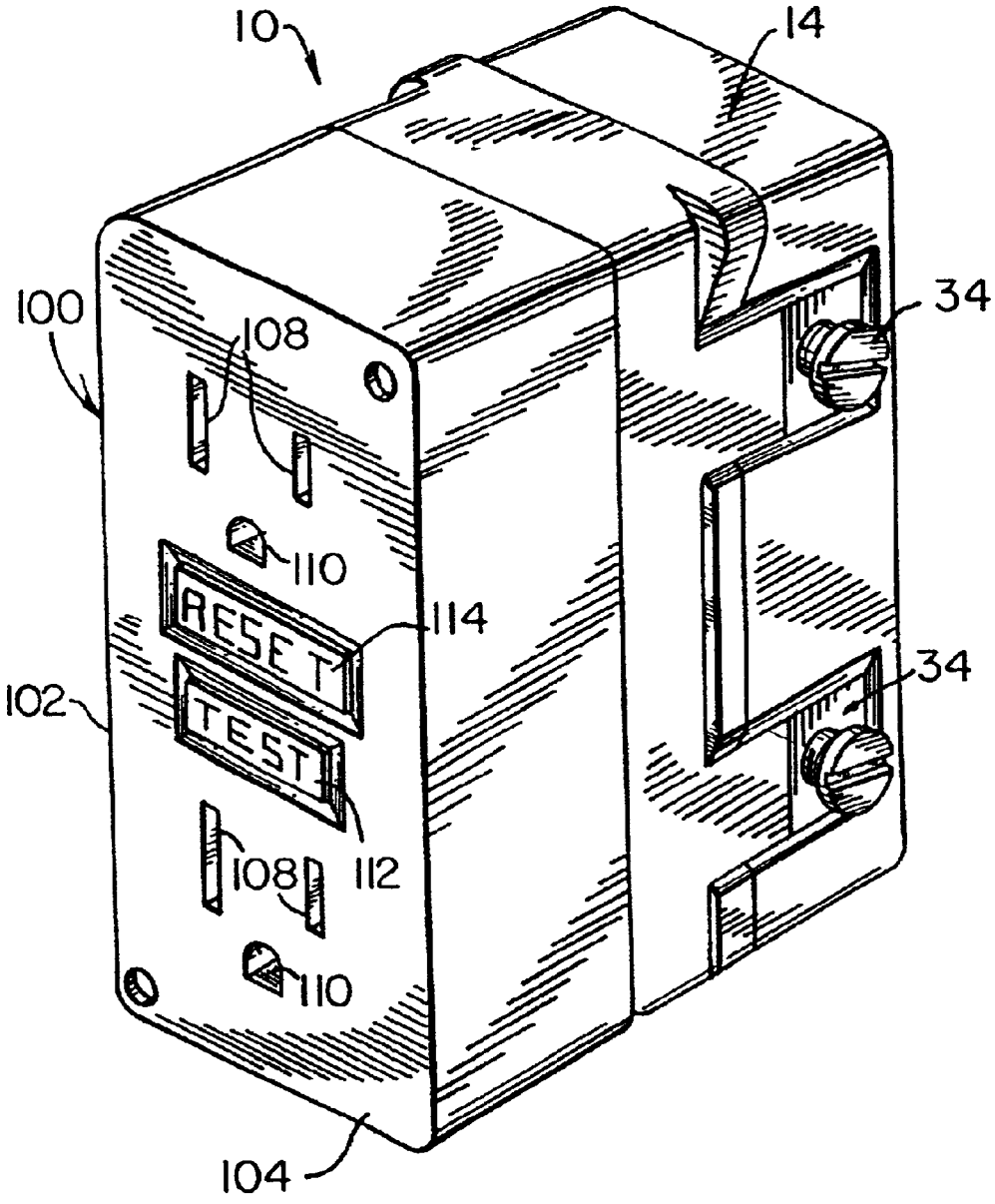
FIG. 10 is a perspective view of one embodiment of a modular electrical component according to the present application, illustrating a replaceable circuit interrupting device mounted to a base unit.
Figure 13:
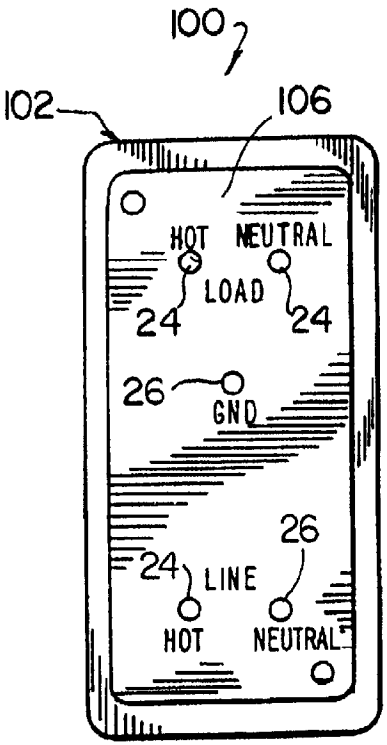
FIG. 13 is a rear elevational view of the circuit interrupting device of the modular electrical component of FIG. 10.
Figure 12:
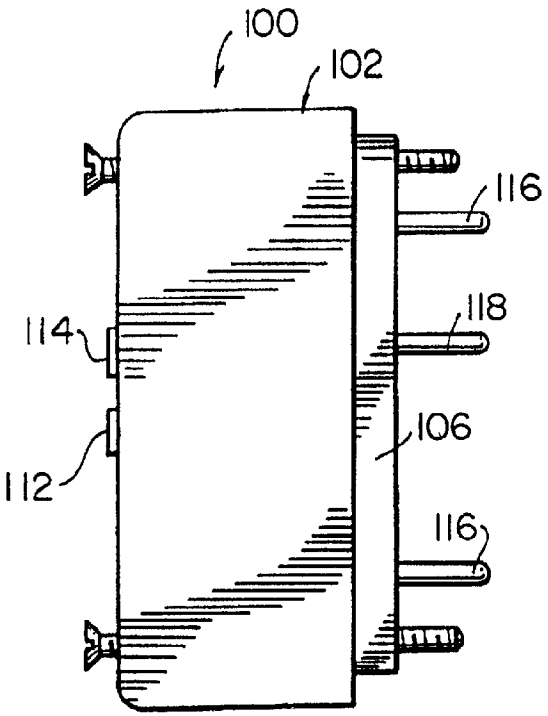
FIG. 12 is a side elevational view of the circuit interrupting device of the modular electrical component of FIG. 10.
Figure 11:
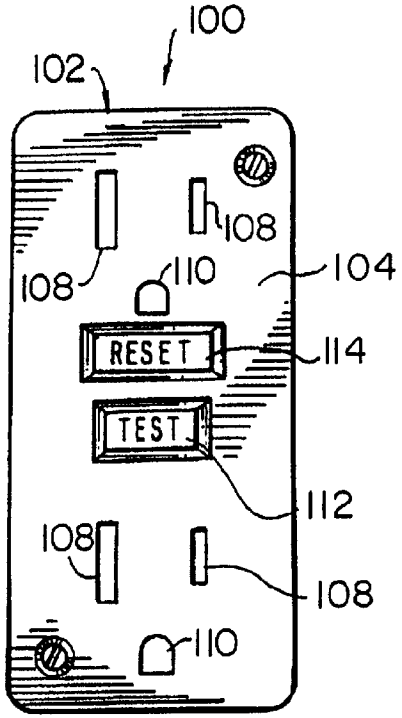
FIG. 11 is a front elevational view of the circuit interrupting device of the modular electrical component of FIG. 10.

As noted above, the modular component concept according to the present application contemplates using the various electrical devices that are used with electrical wiring systems. Examples of such devices include conventional grounded receptacles, switches, circuit interrupting devices (e.g., GFCI and AFCI devices), and circuit interrupting devices with combined circuit protection functions, such as combined GFCI/AFCI devices. The base unit 14 can also be configured as a multiple gang unit capable of mating with more than one electrical device. For example, FIG. 9 shows a three gang base unit 14 that can mate with three electrical devices, such as switches and/or receptacles. The remainder of the present application describes in detail embodiments of the removable electrical device as a GFCI receptacle.

Turning now to FIGS. 10–13, the removable GFCI receptacle 100 has a housing 102 with a face or cover portion 104 and a rear portion 106 which is preferably dimensioned to fit within channel 30*a* in the face cover 30 of the base unit 14 (seen in FIG. 1). The face portion 104 has entry ports 108 for receiving normal or polarized prongs of a male plug of the type normally found at the end of a lamp or appliance cord set (not shown), as well as ground-prong-receiving openings 110 to accommodate a three-wire plug. Power and ground contacts 116 and 118, respectively, extend from the rear portion of the housing 102. The contacts are configured to electrically connect to corresponding terminal connections 34 and ground terminal connections 44 in the base unit 14.

A test button 112 extends through an opening in the face portion 104 of the housing 102. The test button is used to activate a test cycle, which test the operation of a circuit interrupter disposed in the device. The circuit interrupter, to be described in more detail below, is used to detect ground faults and break electrical continuity between input and output conductive paths when a ground fault is detected. It should be noted, that the input conductive path is typically associated with a line side of the device, and the output conductive path is typically associated with the load side of the device.

A reset button 114 forming a part of a reset mechanism extends through an opening in the face portion 104 of the housing 102. In this embodiment of the GFCI receptacle, the reset button 114 is used to activate a reset cycle in which electrical continuity between the input and output conductive paths or conductors is mechanically reestablished. In this embodiment, the Internal components, e.g., the sense circuitry used to detect ground faults and test the device, the electrical contacts and the mechanical components used to reset the GFCI receptacle are substantially similar to those in conventional GFCI receptacles. A more detailed description of a conventional GFCI receptacle is provided in U.S. Pat. No. 4,595,894, which is incorporated herein in its entirety by reference.

In an alternative embodiment of the GFCI receptacle, a reset lockout feature is provided that prevents resetting the receptacle if the circuit interrupter is non-operational. This alternative embodiment will be described with reference to FIGS. 14–18. The housing of this alternative is substantially similar to housing described above for the conventional GFCI receptacle. In this embodiment, a trip button 115 is substituted for the test button 112. Additional differences between the conventional GFCI receptacle and this embodiment of the GFCI receptacle include the internal structure and operational features described below. FIGS. 14–18 show mechanical components of trip and reset mechanisms in various positions. Although the trip and reset mechanisms shown in the drawings are electro-mechanical in nature, the present application also contemplates using semiconductor type trip and reset mechanisms, as well as other mechanisms capable or making and breaking electrical continuity.

Figure 18:
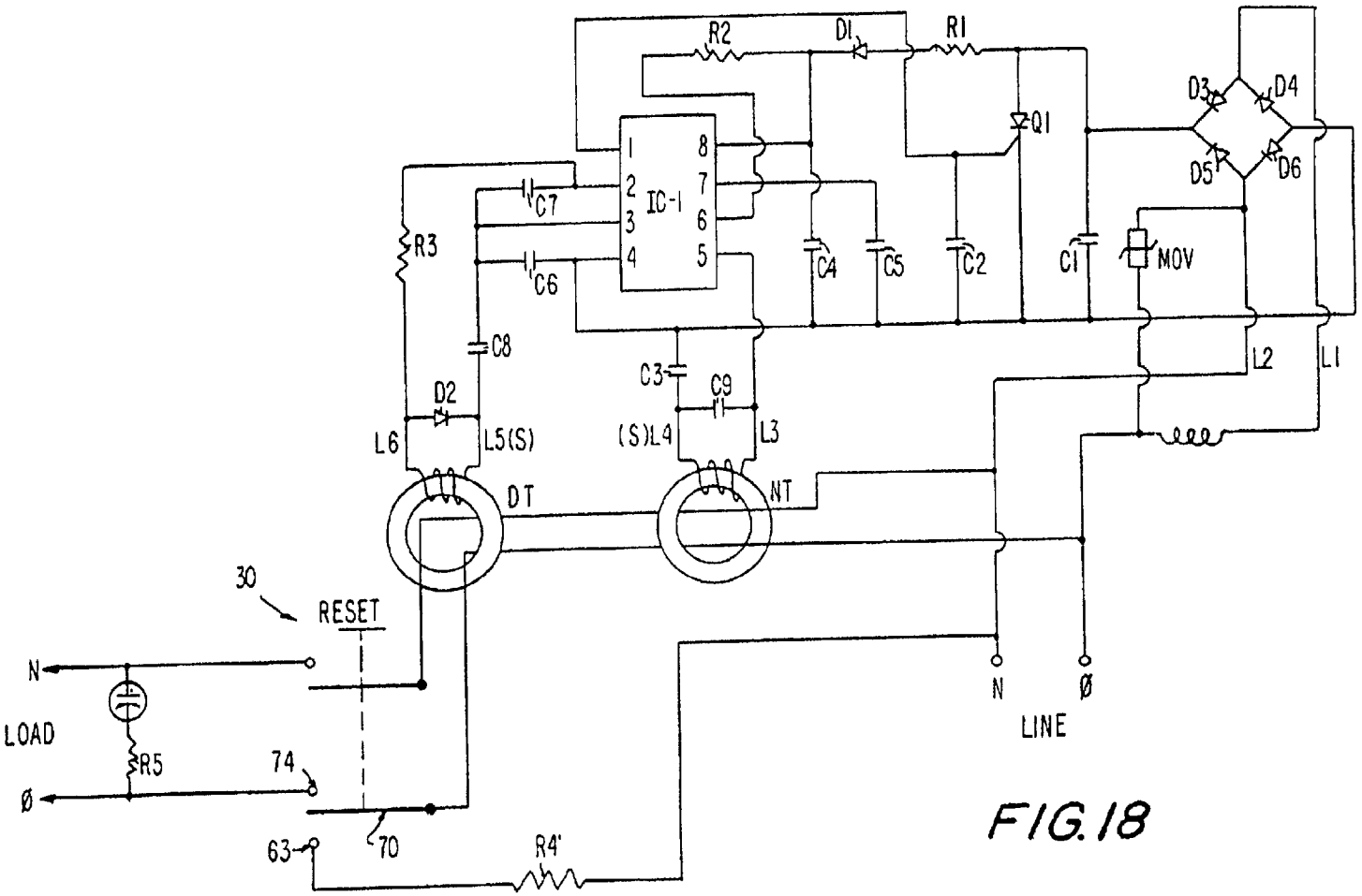
FIG. 18 is a schematic diagram of sense circuitry for detecting ground faults and resetting the GFCI device of FIG. 10.

The trip mechanism includes a coil assembly 130, a plunger 132 responsive to the energizing and de-energizing of the coil assembly and a banger 134 connected to the plunger 132. The banger 134 has a pair of banger dogs 136 and 138 which are used to set and reset the connection between input and output conductors. The trip mechanism is activated in response to the sensing of a ground fault by, for example, the sense circuitry shown in FIG. 18. FIG. 18 includes conventional circuitry for detecting ground faults that includes a differential transformer that senses current imbalances between phase and neutral conductors and a ground transformer that senses ground to neutral current. If either of these sensed currents meet predefined thresholds, the event is classified as a ground fault. As noted, the trip mechanism and fault sensing circuitry are included in the circuit interrupter.

The reset mechanism includes reset button 114, movable latching member 140 connected to the reset button 114 and reset contacts 142 and 144 that temporarily activate the trip mechanism when the reset button is depressed. Preferably, the reset contacts 142 and 144 are normally open momentary contacts.

FIGS. 14–17 show the mechanical components of the trip and reset mechanisms in various stages of operation. In FIG.

Figure 15:
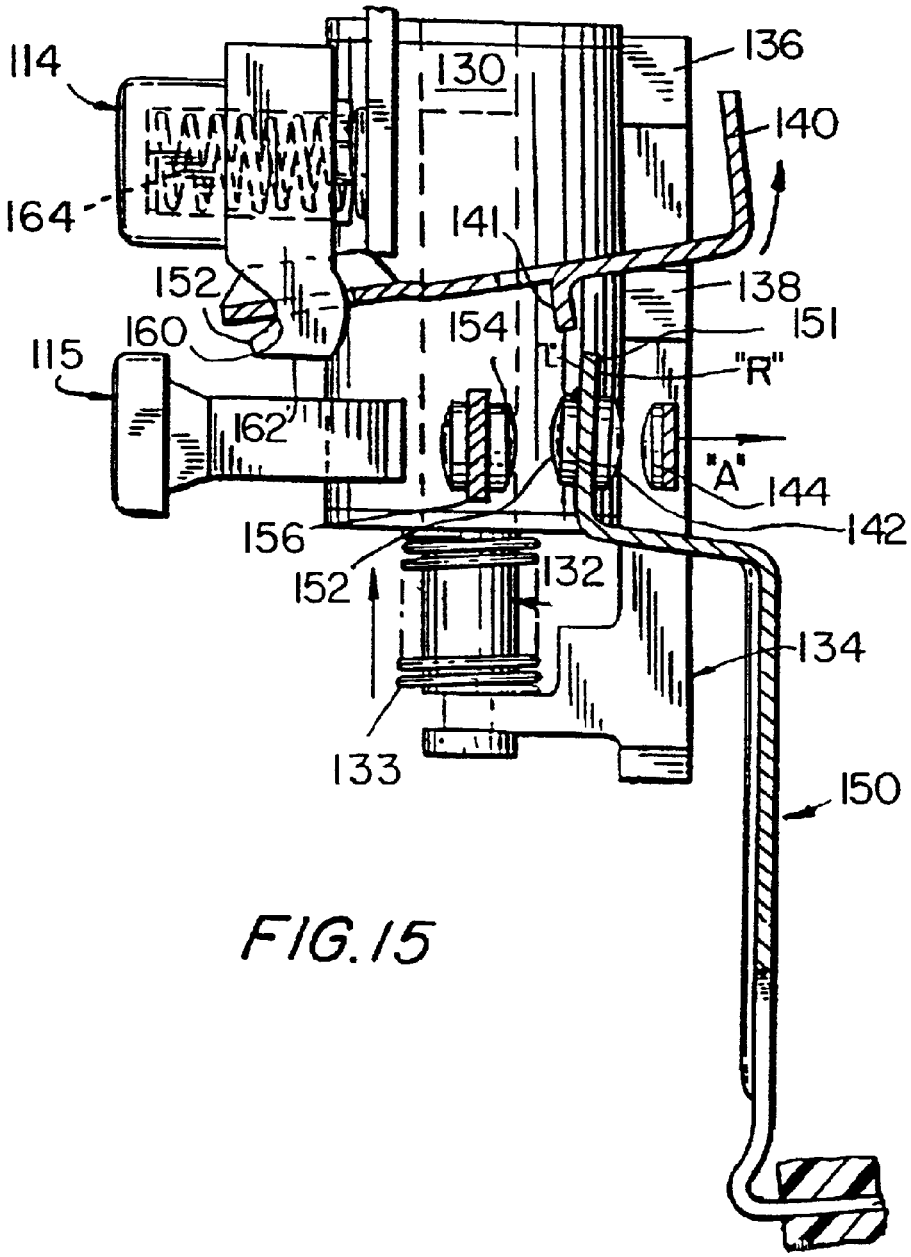
FIG. 15 is a side elevational view similar to FIG. 14, illustrating components of the reset mechanism for the GFCI device In a circuit breaking or interrupting position.

14, the GFCI receptacle is shown in a set position where movable contact arm 150 is in a stressed condition so that movable contact 152 is in electrical engagement with fixed contact 154 of contact arm 156. Referring to FIG. 15, if the sensing circuitry of the GFCI receptacle senses a ground fault or if the trip button 115 is depressed, the coil assembly 130 is energized to draw plunger 132 into the coil assembly 130 so that banger 134 moves upwardly. As the banger moves upwardly, the banger front dog 138 strikes the latch member 140 causing it to pivot in a counterclockwise direction about the joint created by the top edge 158 and inner surface 160 of finger 162. The movement of the latch member 140 removes the latching finger 141 from engagement with side R of the remote end 151 of the movable contact arm 150, and permits contact arm 150 to return to its pre-stressed condition opening contacts 152 and 154. It should be noted that the description thus far has been in terms of a single latch member 140 and a single contact arm 150. However, there are preferably two sets of latch members 140 and contact arms 150: one set for the phase (or hot) conductors; and the other set for the neutral conductors. Further, the banger 134 preferably has two sets of banger dogs: one set for the phase conductors; and the other set for the neutral conductors.

Figure 16:
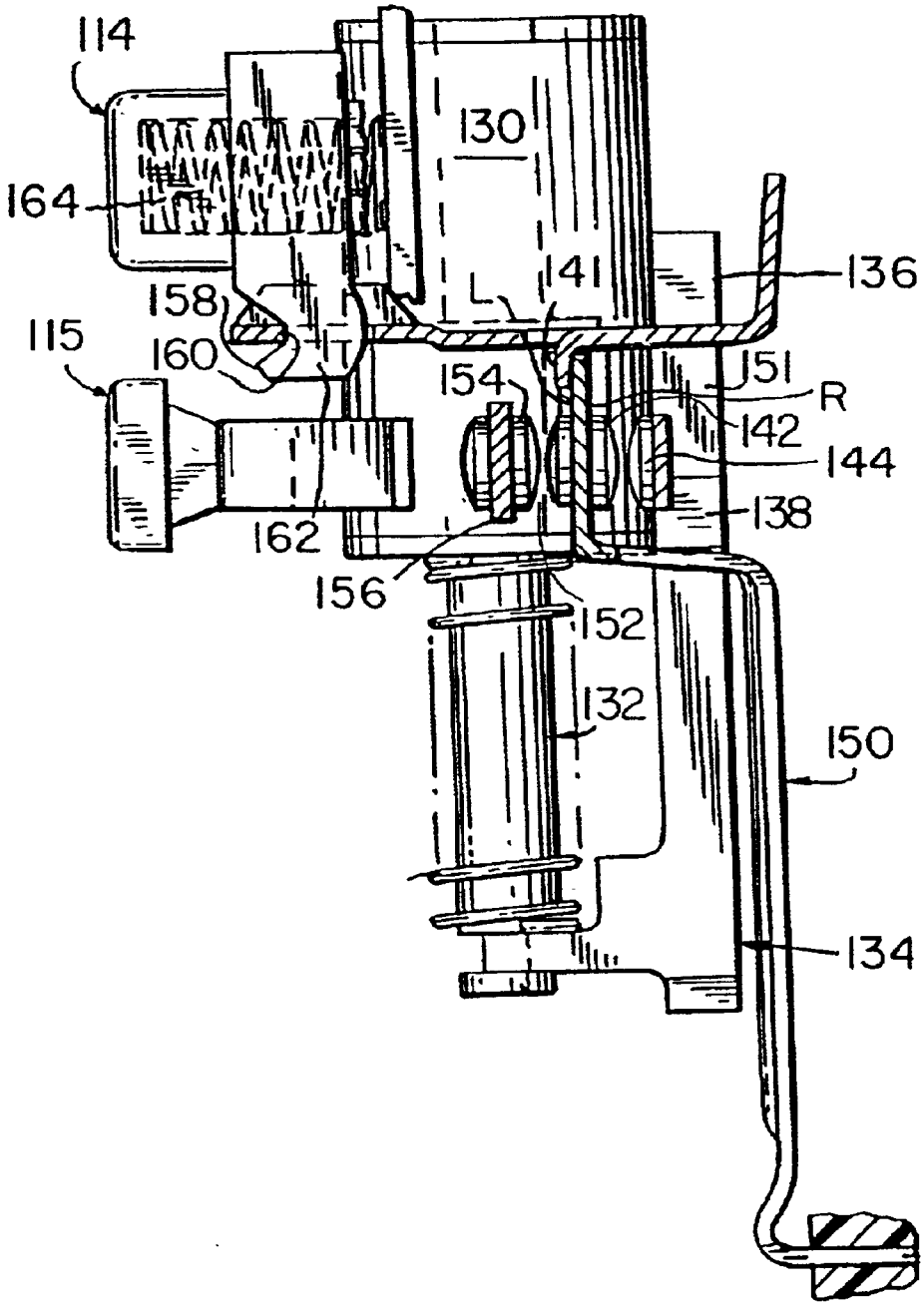
FIG. 16 is side elevational view similar to FIG. 14, illustrating components of the reset mechanism and the GFCI device in a reset lockout position.

After tripping, the coil assembly 130 is de-energized so that spring 133 returns plunger 132 to its original extended position and banger 134 moves to its original position releasing latch member 140. At this time the latch member 140 is in a lock-out position where latch finger 141 inhibits movable contact 152 from engaging fixed m contact 154, as seen in FIG. 16. In this embodiment, latching finger 141 acts as an active inhibitor that prevents the contacts from touching. Alternatively, the natural bias of movable arm 150 can be used as a passive inhibitor that prevents contacts 152 and 154 from touching.

Figure 17:
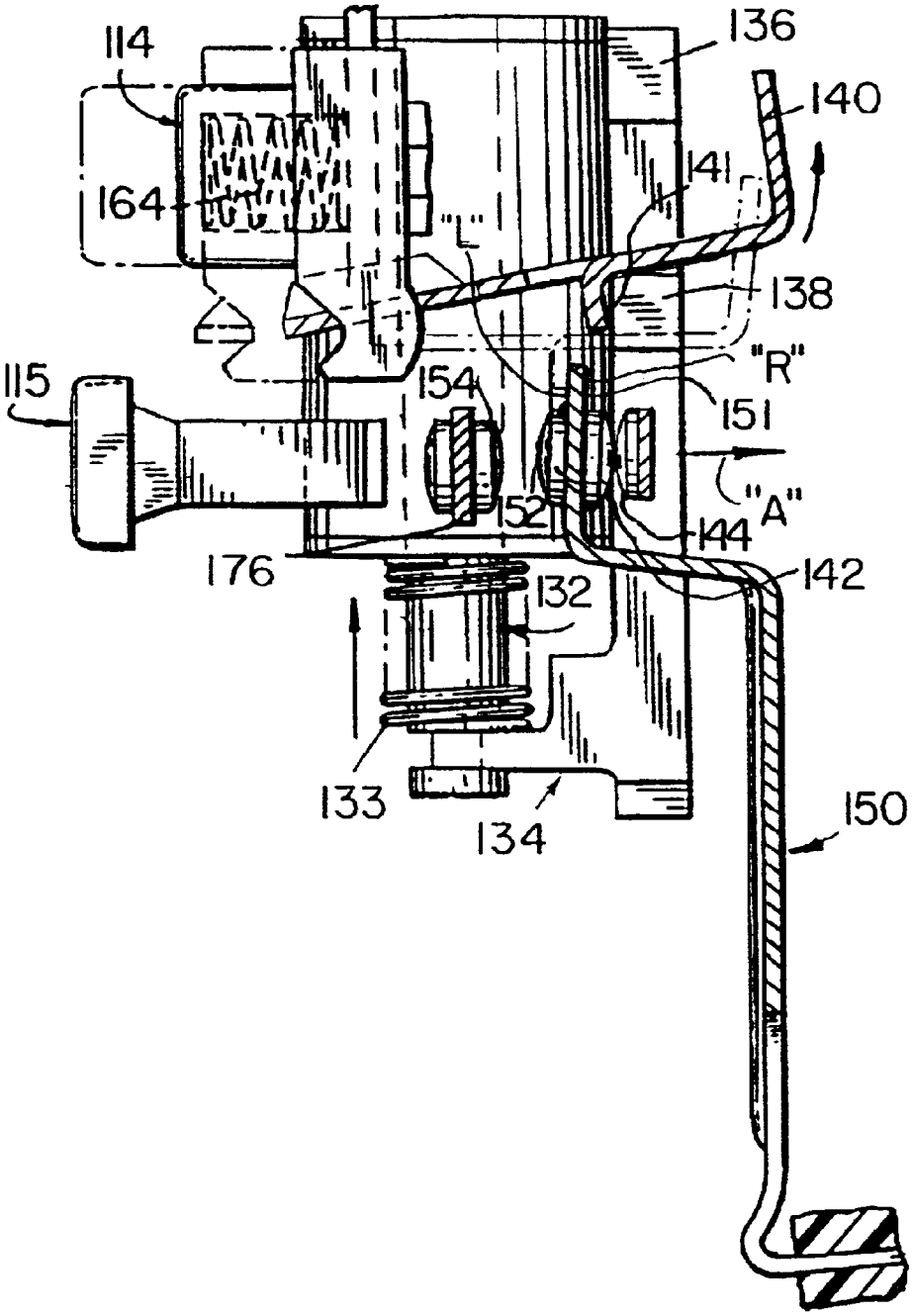
FIG. 17 is a side elevational view similar to FIG. 14, illustrating the components of the reset mechanism after a reset button has been depressed.

To reset the GFCI receptacle so that contacts 152 and 154 are closed and continuity between the input and output conductors is reestablished, the reset button 114 is depressed sufficiently to overcome the bias force of return spring 164 and move the latch member 140 in the direction of arrow A, seen in FIG. 15. While the reset button 114 is depressed, latch finger 141 contacts side L of the movable contact arm 150 and continued depression of the reset button 114 forces the latch member 140 to overcome the stress force exerted by the arm 150 causing the reset contact 142 on the arm 150 to close on reset contact 144. Closing the reset contacts completes a test circuit so that the test cycle is activated so that a ground fault condition is simulated. During the test cycle the plunger 132 moves the banger 134 upwardly so that the banger strikes the latch member 140 pivoting the latch finger 141 while the latch member 140 continues to move in the direction of arrow A. As a result, the latch finger 141 is lifted over side L of the remote end 151 of the movable contact arm 150 onto side R of the remote end of the movable contact arm, as seen in FIGS. 14 and 17.

Figure 14:
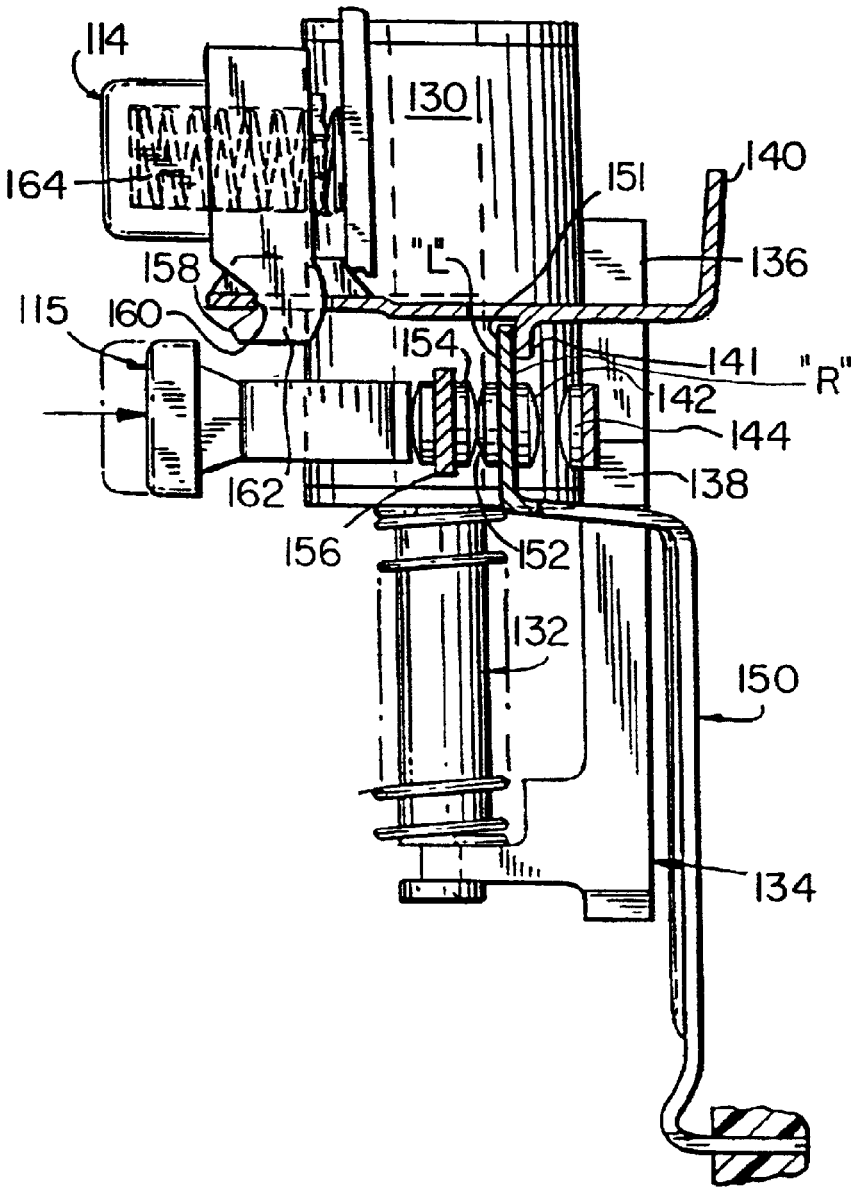
FIG. 14 is side elevational view, partly in section, of a reset mechanism for the GFCI device shown in FIG. 10, illustrating components of the reset mechanism and the GFCI device in a set or circuit making position.

After tripping, the coil assembly 130 is de-energized so that so that plunger 132 returns to its original extended position, and banger 134 releases the latch member 140 so that the latch finger 141 is in a reset position, seen in FIG. 14. Release of the reset button causes the latching member 140 and movable contact arm 150 to move so that contact 152 electrically engages contact 154.

As described, in this embodiment, the GFCI receptacle is prevented from resetting if the circuit interrupter is non-operational. To replace a non-operational GFCI receptacle, a homeowner, for example, simply removes the GFCI receptacle 100 from the base unit 14 and inserts a new GFCI receptacle. A more detailed description of a GFCI device with reset lockout and independent trip functions is provided in commonly, copending application Ser. No. 09/369,759 filed Aug. 6, 1999, which is incorporated herein in its entirety by reference.

It will be understood that various modifications can be made to the embodiments of the present application described herein without departing from the spirit and scope thereof. Therefore, the above description should not be construed as limiting the application, but merely as preferred embodiments thereof. Those skilled in the art will envision other modifications within the scope and spirit of the application as defined by the claims appended hereto.

What is claimed is:

1. A modular electrical wiring device assembly, comprising:

a base component having side walls formed with a plurality of first cavities as well as a plurality of interior grooves formed therein to receive a plurality of electrically conductive members including receptacle contact surfaces;

a central adaptor component formed independently of said base component, the central adaptor component having a plurality of projecting posts for inserting into the grooves, wherein each of the projecting posts is inserted into corresponding grooves and nestling within each of said first cavities to hold each of the conductive members between the base component and said central adaptor component, a front of the central adaptor component having a second cavity bounded by a circumference side wall, and a plurality of openings formed therethrough; and an electrical wiring device component having opposite faces and a rear portion, said electrical wiring device component including electrically conductive projections extending from said rear portion, said rear portion being inserted into and nestling within said second cavity, said electrically conductive projections extending through said openings in said recessed wall and into electrical contact with said receptacle contact surfaces when said electrical wiring device component is assembled with said central adaptor component and the base component.

2. The modular electrical wiring device assembly according to claim 1, wherein at least one ground terminal connection extends into said base component; and wherein said electrical wiring device component has at least one ground contact extending from said rear portion of the electrical wiring device component, said at least one ground contact being capable of being releasably connected to said at least one ground terminal connection.

3. The modular electrical wiring device assembly according to claim 1, wherein said electrical wiring device component comprises a receptacle.

4. The modular electrical wiring device assembly according to claim 1, wherein said electrical wiring device component comprises a switch.

5. The modular electrical wiring device assembly according to claim 1, wherein said electrical wiring device component comprises a circuit interrupting device.

6. The modular electrical wiring device assembly according to claim 1, wherein said base component is configured to fit within a single gang junction box in an electrical wiring system.

7. The modular electrical wiring device assembly according to claim 1, wherein said base is configured to fit within a multiple gang junction box in an electrical wiring system.

8. The modular electrical wiring device assembly according to claim 1, wherein a circuit interrupting portion located within the electrical wiring device component for breaking a conductive path to at least one of the electrically conductive projections.

9. The modular electrical wiring device assembly according to claim 8, wherein at least one ground terminal connection extends into said base component; and wherein said electrical wiring device component has at least one ground contact extending from said rear portion of the electrical wiring device component, said at least one ground contact being capable of being releasably connected to said at least one ground terminal connection.

10. The modular electrical wiring device assembly according to claim 8, wherein said electrical wiring device component comprises a receptacle.

11. The modular electrical wiring device assembly according to claim 8, wherein said electrical wiring device component comprises a switch.

12. The modular electrical wiring device assembly according to claim 8, wherein said electrical wiring device comprises a circuit interrupting device.

* * * * *